US006199399B1

(12) United States Patent
Voorhis

(10) Patent No.: US 6,199,399 B1
(45) Date of Patent: Mar. 13, 2001

(54) BI-DIRECTIONAL REFRIGERANT EXPANSION AND METERING VALVE

(75) Inventor: Roger J. Voorhis, Repulse Bay (HK)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/443,608

(22) Filed: Nov. 19, 1999

(51) Int. Cl.[7] ..... F25B 13/00
(52) U.S. Cl. ..... 62/324.6; 62/324.1; 62/511
(58) Field of Search ..... 62/511, 324.1, 62/324.6, 160, 115, 498

(56) References Cited

U.S. PATENT DOCUMENTS

| | | | | |
|---|---|---|---|---|
| 4,311,020 | * | 1/1982 | Tobin et al. | 62/324.6 |
| 4,445,343 | * | 5/1984 | McCarty | 62/324.1 |
| 4,653,291 | * | 3/1987 | Moeller et al. | 62/511 |
| 4,793,150 | * | 12/1988 | Wattley et al. | 62/296 |
| 5,029,454 | | 7/1991 | Eisberg | 62/324 |
| 5,031,416 | | 7/1991 | Drucker et al. | 62/324 |
| 5,038,579 | | 8/1991 | Drucker | 62/324 |
| 5,052,192 | | 10/1991 | Drucker | 62/324 |
| 5,085,058 | * | 2/1992 | Aaron et al. | 62/324.6 |
| 5,186,021 | * | 2/1993 | Keller | 62/511 |
| 5,345,780 | | 9/1994 | Aaron et al. | 62/324 |
| 5,689,972 | * | 11/1997 | Schuster et al. | 62/511 |
| 5,806,326 | * | 9/1998 | Watanabe et al. | 62/114 |
| 5,808,209 | | 9/1998 | Zielinska et al. | 73/861 |
| 5,813,244 | * | 9/1998 | Palmer | 62/324.6 |
| 5,966,960 | * | 10/1999 | Cummings et al. | 62/296 |
| 6,006,544 | * | 12/1999 | Watanabe et al. | 62/511 |

* cited by examiner

*Primary Examiner*—Corrine McDermott
*Assistant Examiner*—Marc Norman
(74) *Attorney, Agent, or Firm*—William J. Beres; William O'Driscoll; Peter D. Ferguson

(57) ABSTRACT

A bi-directional refrigerant metering and expansion valve. The bi-directional valve comprises a body; a short tube portion in the body, a heating inlet portion and a cooling inlet portion. The short tube portion includes a tubular portion having a short tube length, a short tube diameter, and a pre-selected short tube length to short tube diameter ratio and includes first and second ends interconnected by the tubular portion. The heating inlet portion is connected to the first end of the short tube portion, and includes a heating inlet chamfer having a first length and a first angle of a first magnitude. The cooling inlet portion is connected to the second end of the short tube portion, and includes a cooling inlet chamfer having a second length and a cooling inlet angle of a second magnitude. The second length is greater than the first length.

19 Claims, 3 Drawing Sheets

BI-DIRECTIONAL REFRIGERANT EXPANSION AND METERING VALVE

BACKGROUND OF THE INVENTION

The present invention is directed to a bi-directional refrigerant expansion and metering valve for use in a minisplit air conditioner, a heat pump system, or an air conditioning system. The bi-directional refrigerant expansion and metering valve is an alternative to metering valves, to capillary tube and to other expansion valve concepts.

Present heat pump systems either require two metering valves with differing diameters and differing short tube length to diameter ratios in order to properly operate, or fail to fully utilize bi-directional valves. The use of two metering valves is subsequently discussed with regard to FIGS. 1A and 1B. Most bi-directional metering valves are complex spring loaded or shuttle arrangements such as are shown in U.S. Pat. Nos. 5,029,454 to Eisberg, 5,052,192 to Drucker, and 5,038,579 to Drucker. The spring or shuttle changes position to compensate for changes in flow direction. However, these patents fail to recognize that controlling the geometry of both ends can control the flow rate entering those respective ends. The bi-directional valve of U.S. Pat. No. 5,345,780 recognizes the advantages of controlling the approach to one end of a short tube restrictor but fails to appreciate the advantages of controlling both approaches.

It would be advantageous to minimize the number and type of refrigerant expansion and metering components.

SUMMARY OF THE INVENTION

It is an object, feature and advantage of the present invention to solve the problems of prior art metering valves.

It is a further object, feature and advantage of the present invention to eliminate previous metering valves in favor of a bi-directional system that has a reduced cost and a reduced number of components.

It is an object, feature and advantage of the present invention to provide proper metering for a given short tube length to diameter ratio.

It is a further object, feature and advantage of the present invention to have a metering arrangement with no moving parts and only a single short tube restrictor device.

It is a further object, feature and advantage of the present invention to provide a bi-directional refrigerant metering and expansion valve which includes a short tube restrictor and which controls the approaches to each end of the restrictor.

It is a further object, feature and advantage of the present invention to differentiate the approaches so as to cause differing flow rates through the short tube restrictor depending upon the direction of access.

The present invention provides a bi-directional refrigerant metering and expansion valve. The bi-directional valve comprises a body; a short tube portion in the body, a heating inlet portion and a cooling inlet portion. The short tube portion includes a tubular portion having a short tube length, a short tube diameter, and a pre-selected short tube length to short tube diameter ratio and includes first and second ends interconnected by the tubular portion. The heating inlet portion is connected to the first end of the short tube portion, and includes a heating inlet chamfer having a first length and a first angle of a first magnitude. The cooling inlet portion is connected to the second end of the short tube portion, and includes a cooling inlet chamfer having a second length and a cooling inlet angle of a second magnitude. The second length is greater than the first length.

The present invention also provides a method of metering refrigerant flow in expansion in a heat pump system. The method comprises the steps of: chamfering a first end of a bi-directional metering and expansion device to a first set of requirements to produce a first chamfer angle; chamfering a second end of the metering device to a second set of requirements to produce a second chamfer angle less than the first chamfer angle; operating in a heating mode wherein refrigerant flows into the first end and out the second end; and operating a cooling mode wherein refrigerant flows into the second end and out the first end.

BRIEF DESCRIPTION OF THE DRAWINGS

FIG. 1A shows the cooling configuration while FIG. 1B shows the heating configuration.

FIG. 2A shows the cooling configuration and FIG. 2B shows the heating configuration.

DETAILED DESCRIPTION OF THE INVENTION

Figure 1A:
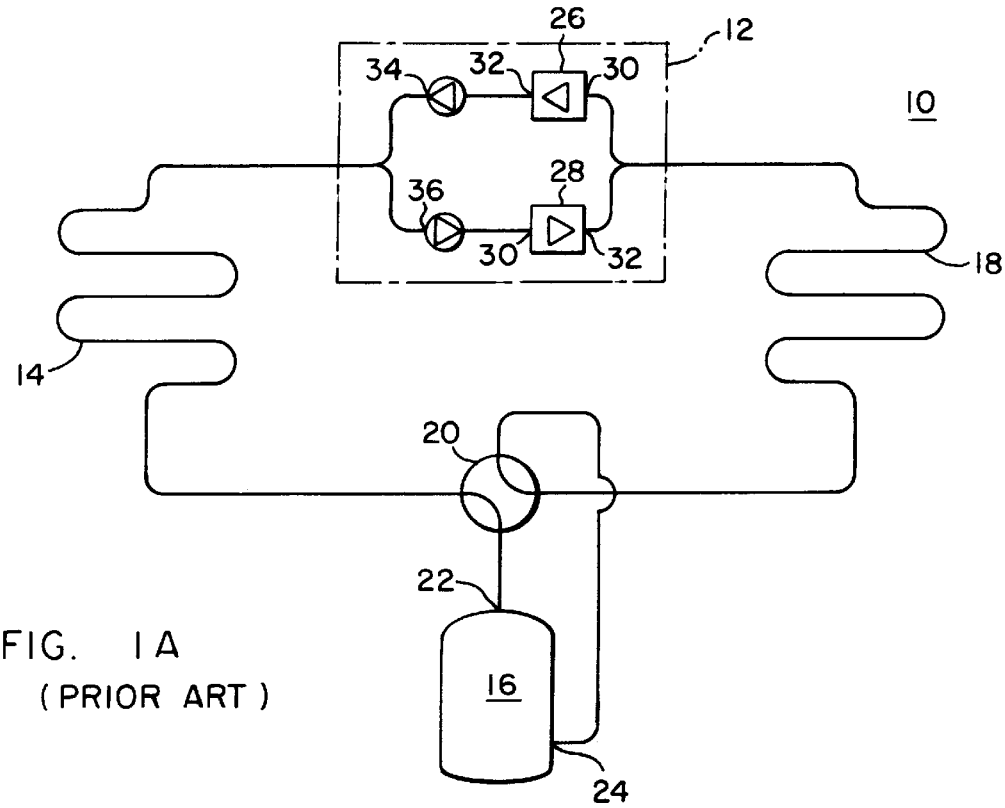
FIG. 1A (PRIOR ART)
FIGS. 1A and 1B show a prior art heat pump system having two metering valves.

The present invention is directed to a bi-directional refrigerant metering and expansion valve for use in a minisplit air conditioning system, a heat pump air conditioning system, or a conventional split system air conditioning system. The present invention will be discussed in terms of a generic heat pump system but a person of ordinary skill in the art will recognize the invention's applicability to the systems enumerated above as well as to other similar systems. In the following discussion, like reference numerals will be used for like elements.

Figure 1B:
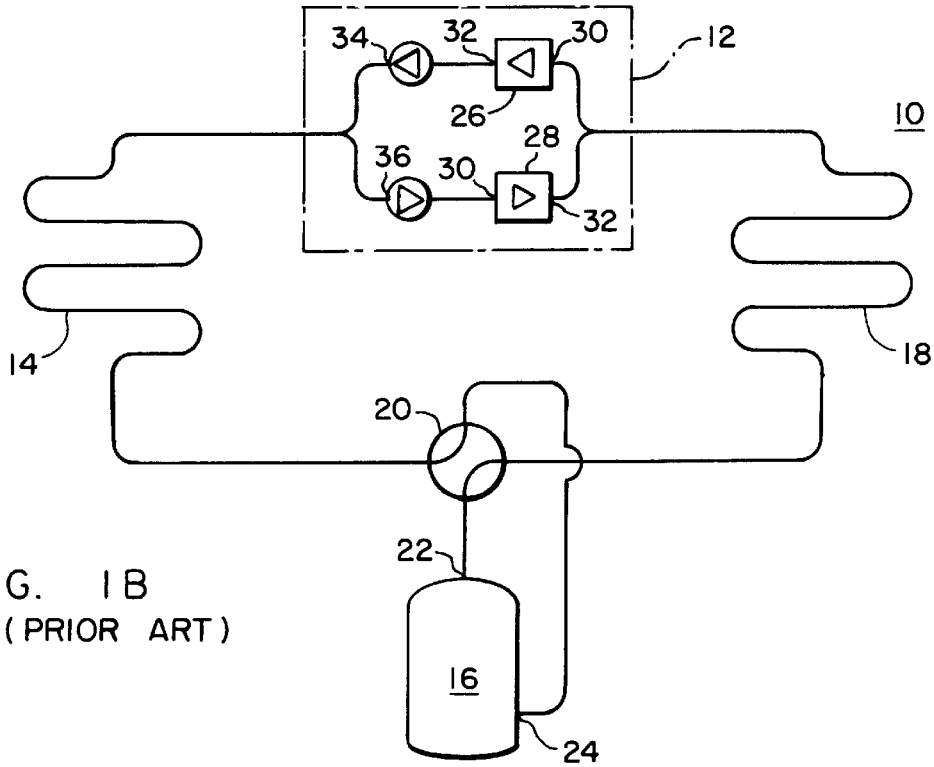
FIG. 1B (PRIOR ART)
Figure 2A:
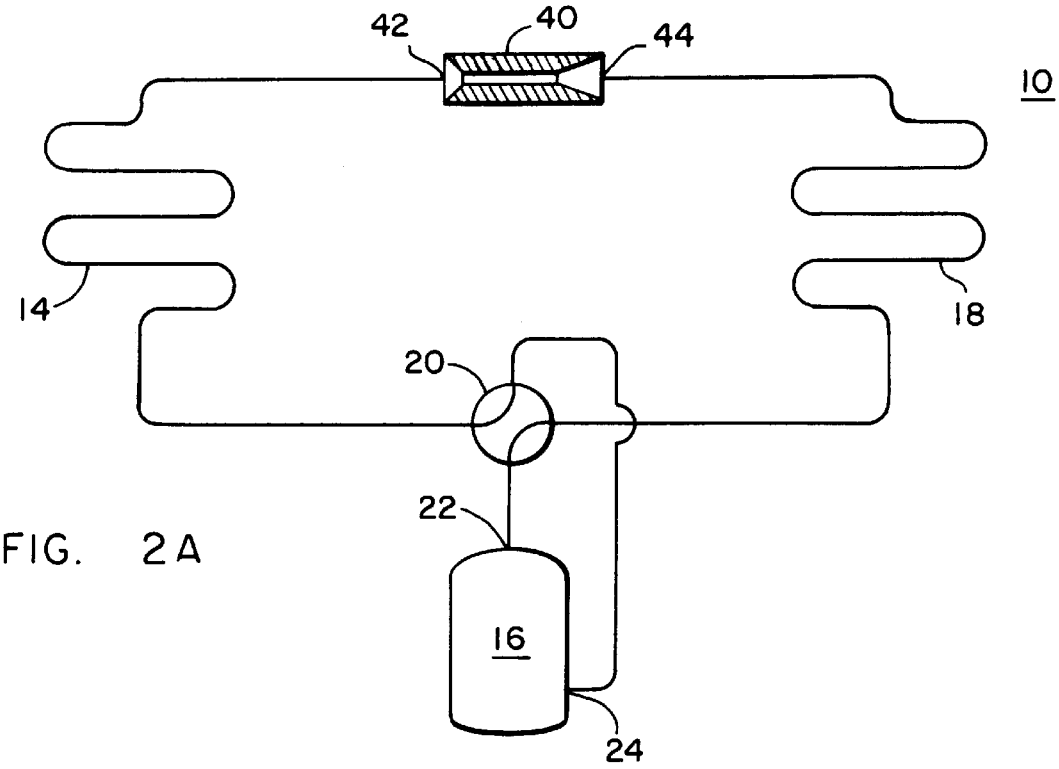
FIGS. 2A and 2B show the bi-directional metering and expansion valve of the present invention incorporated into a heat pump system.
Figure 2B:
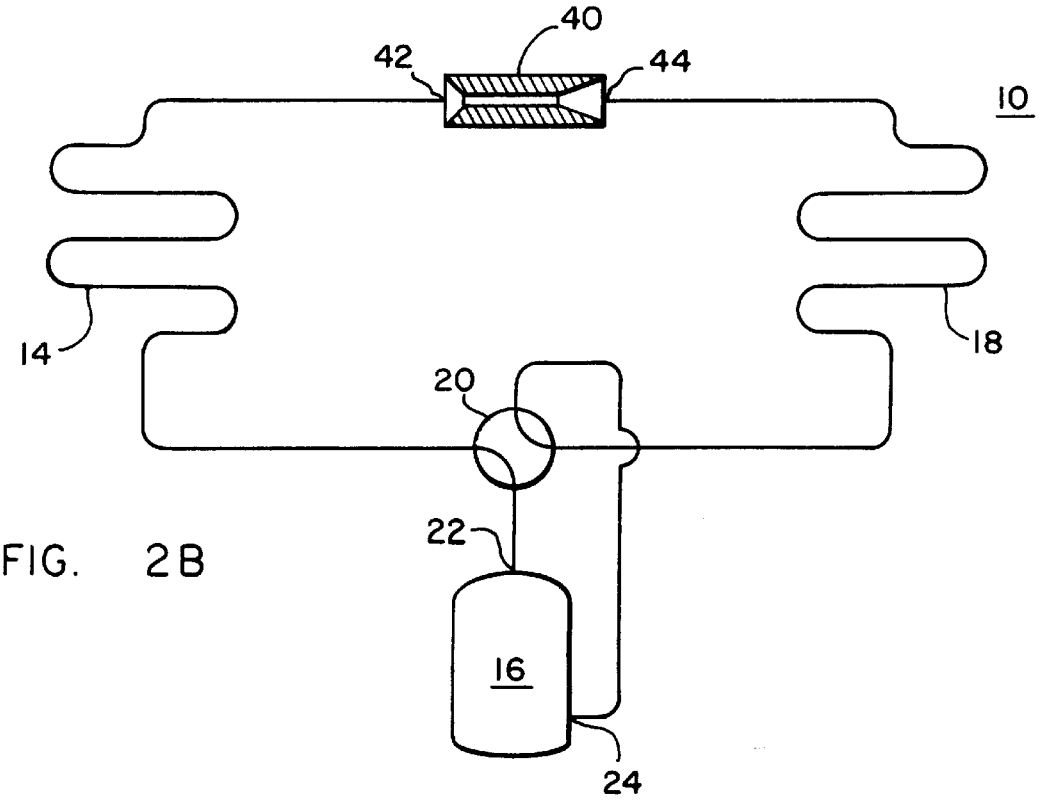

FIGS. 1A and 1B show a heat pump system 10 including a prior art metering arrangement 12. FIG. 1A shows the system 10 in a cooling configuration including an outdoor heat exchanger 14 operable as a condenser in the cooling configuration, a compressor 16, and an indoor heat exchanger 18 configured as an evaporator in the cooling configuration. The compressor 16, the condenser 14, the metering arrangement 12 and the indoor heat exchanger 18 are serially linked to form system 10. A four-way valve 20 is connected to the compressor outlet 22 and to the compressor inlet 24 and is operable to switch between the cooling configuration of FIG. 1A and the heating configuration of Figure 1B. When in the heating configuration, the indoor heat exchanger 18 is operable as a condenser and the outdoor heat exchanger 14 is operable as an evaporator.

FIGS. 1A and 1B show a prior art metering arrangement 12 including metering valves 26 and 28. Each of these metering valves 26, 28 can be chamfered at a first end 30 and unchamfered at a second end 32. The uni-directional metering valves 26 and 28 are arranged in parallel and include check valves 34, 36 respectively limiting refrigerant flow to enter the uni-directional valves 26, 28 at the chamfered side 30 and to exit the valve 26, 28 at the unchamfered side 32.

The present invention replaces the prior metering arrangements 12 and the prior bi-directional valves with a bi-directional refrigerant metering and expansion valve 40 which has no moving parts and which comprises a single component.

The bi-directional valve 40 includes a first end 42 providing an inlet for cooling purposes and a second end 44 providing an inlet for heating purposes. Specifically referring to FIG. 3, the bi-directional valve 40 includes a heating inlet portion 46, a short tube portion 48 and a cooling inlet portion 50. The maximum height 52 of each of portions 46, 48 and 50 is a constant of the same magnitude for each of these portions 46, 48, 50. The short tube portion 48 forms a short tube restrictor 49 having a diameter shown by 54 and a length shown by 56. In the preferred embodiment, the length to diameter ratio of the short tube restrictor 49 is greater than 5 and less than 40. The heating inlet portion 44 has a length or chamfer depth 58 and has a chamfer angle 60. The cooling inlet portion 50 has a length or chamfer depth 62 and has a chamfer angle 64.

The present invention recognizes that short tube restrictors such as short tube restrictor 49 require a specific length to diameter ratio to properly control refrigerant mass flow and require dimensional control over both the heating inlet dimensions and the cooling inlet dimensions to achieve that control. Consequently, the heating inlet and cooling inlet chamfer dimensions 62, 58, 60, 64 are critical to providing proper metering. The effect of the heating inlet chamfering and the cooling inlet chamfering can result in a large variation in expected metering performance for a given length to diameter ratio for the short tube portion 48. Previously, the chamfer dimensions were controlled so that the depths were very small and previous typical systems typically required two distinct uni-directional metering devices with different diameters and differing length to diameter ratios in order to provide adequate metering for both heating and cooling flow in opposing directions.

In the present invention, the heating inlet and cooling inlet chamfer dimensions 58, 60, 62, 64 are selected for a specific short tube restrictor's length to diameter ratio 56, 54 to enable metering of refrigerant in both directions. More specifically, the length 62 of the cooling inlet portion 50 is greater than the length 58 of the heating inlet portion 46. On the other hand, the chamfer angle 60 of the heating inlet portion 46 is greater than the chamfer angle 64 of the cooling inlet portion 50. Both ends 42, 44 of the bi-directional valve body 40 are chamfered, but have different effective restriction sizes for each different direction of flow. This permits the use of a single sharp edged orifice design with different chamfered lengths 62, 58. Thus refrigerant flow into the cooling inlet portion 50 will have a different metering rate and rate of expansion than refrigerant flow into the opposed heating inlet end 44.

Figure 3:
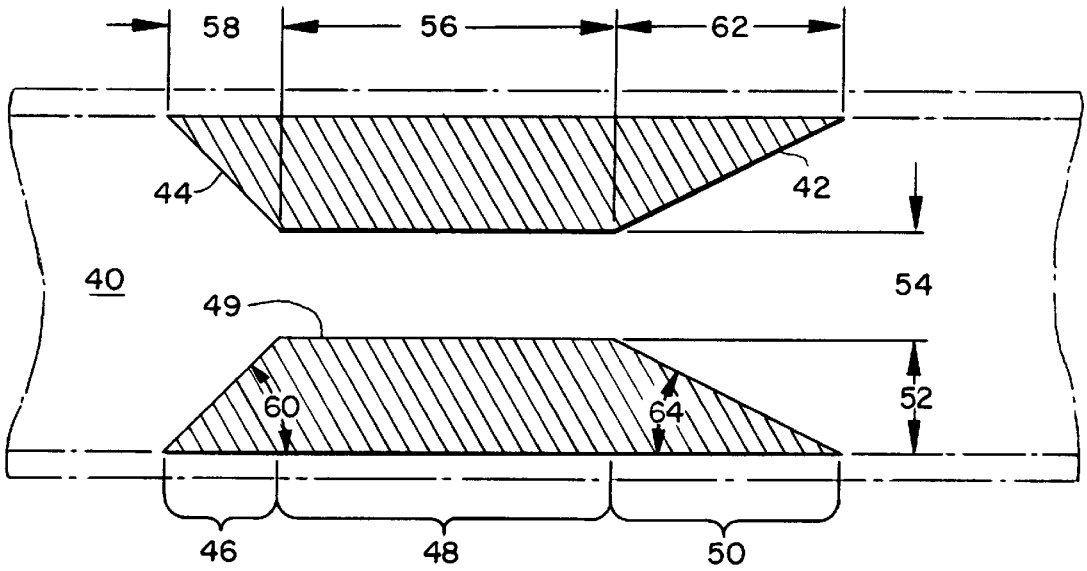
FIG. 3 shows the bi-directional refrigerant metering and expansion valve of the present invention.
Figure 4:
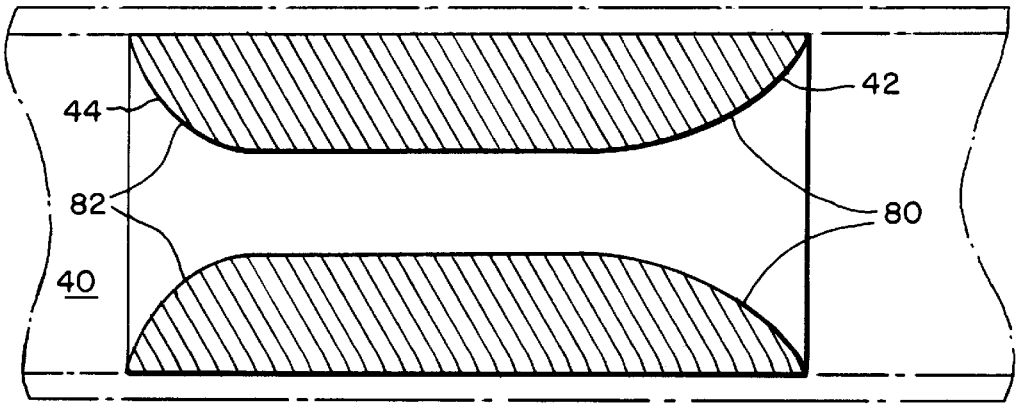
FIG. 4 shows an alternative embodiment of the invention of FIG. 3.

FIG. 4 is an alternative embodiment of the invention as shown in FIG. 3 where like reference numerals are used for like features. It is further contemplated that a first end might have a fixed slope such as shown in FIG. 3 and the second end might have the arc chamfer 82 such as shown in FIG. 4. In the alternative embodiment the slope of the chamfer does not represent a slope with a fixed angle. Rather, the chamfer at the first end 42 is represented by a non-linear arc 82, and the chamfer at the second end 44 is represented by a non-linear arc 80. In FIG. 4 the chamfer 80 is arced from the first angle, and the chamfer 82 at the second end 44 is arced from the second angle. These arcs 80, 82 can be based on a circle, an ellipse, or other similar figure. In FIG. 3, the chamfers have a fixed slope and a fixed angle.

What has been described as a bi-directional refrigerant metering and expansion valve having no moving parts and yet which is effective to meter refrigerant flow and expansion in several directions. It will be apparent to a person of ordinary skill in the art that many variations in this design are possible as well as many variations in the designs application. All such variations in design and application are contemplated to fall within the spirit and scope of the claimed invention. What is desired as letters patent is set forth in the following claims.

What is claimed is:

1. A bi-directional refrigerant metering and expansion valve comprising:

a body;

a short tube portion in the body including a tubular portion having a short tube length, a short tube diameter, and a pre-selected short tube length to short tube diameter ratio and including first and second ends interconnected by the tubular portion;

a heating inlet portion, connected to the first end of the short tube portion, and including a heating inlet chamfer having a first length and a first angle of a first magnitude;

a cooling inlet portion, connected to the second end of the short tube portion, and including a cooling inlet chamfer having a second length and a cooling inlet angle of a second magnitude;

wherein the second length is greater than the first length.

2. The valve of claim 1 wherein the first angle is greater than the second angle.

3. The valve of claim 2 wherein the short tube length to short tube diameter ratio is greater than five and less than forty.

4. The valve of claim 2 wherein the cooling inlet chamfer has a fixed slope.

5. The valve of claim 4 wherein the heating inlet chamfer is of a fixed slope.

6. The valve of claim 4 wherein the heating inlet chamfer is of an arced slope.

7. The valve of claim 2 wherein the cooling inlet chamfer is of an arced slope.

8. The valve of claim 7 wherein the heating inlet chamfer is arced.

9. The valve of claim 2 wherein the heating inlet chamfer is arced.

10. The valve of claim 2 wherein the heating inlet chamfer has a fixed slope.

11. A method of metering refrigerant flow in expansion in a heat pump system comprising the steps of:

chamfering a first end of a bi-directional metering and expansion device to a first set of requirements to produce a first chamfer angle;

chamfering a second end of the metering device to a second set of requirements to produce a second chamfer angle less than the first chamfer angle;

operating in a heating mode wherein refrigerant flows into the first end and out the second end; and operating a cooling mode wherein refrigerant flows into the second end and out the first end.

12. The method of claim 11 wherein the first end has a first chamfer length and the second end has a second chamfer length and wherein the second chamfer length is greater than the first chamfer length.

13. The method of claim 11 wherein the first end chamfering step includes the further step of chamfering the first end at a fixed angle from the first chamfer angle.

14. The method of claim 11 wherein the first end chamfering step includes the further step of chamfering the first end at an arc from the first chamfer angle.

15. The method of claim 14 wherein the second end chamfering step includes the further step of chamfering the second end at a fixed angle from the first chamfer angle.

16. The method of claim 14 wherein the second end chamfering step includes a further step of chamfering the second end at an arc from the first chamfer angle.

17. The method of claim 11 wherein the second end chamfering step includes a further step of chamfering the second end at a fixed slope from the second chamfer angle.

18. The method of claim 17 wherein the first end chamfering step includes the further step of chamfering the first end at a fixed slope from the first chamfer angle.

19. The method of claim 11 wherein the second end chamfering step includes the further step of chamfering the second end at an arc from the second chamfer angle.

* * * * *